US009862542B2

(12) United States Patent
Mashburn et al.

(10) Patent No.: US 9,862,542 B2
(45) Date of Patent: Jan. 9, 2018

(54) TRASH CAN WITH CUSTOMIZABLE FEATURES

(71) Applicants: Mars Mashburn, Houston, TX (US); Tim Tobola, Houston, TX (US); Trent Veazey, Houston, TX (US)

(72) Inventors: Mars Mashburn, Houston, TX (US); Tim Tobola, Houston, TX (US); Trent Veazey, Houston, TX (US)

(73) Assignee: Tramontina USA, Inc., Sugar Land, TX (US)

( * ) Notice: Subject to any disclaimer, the term of this patent is extended or adjusted under 35 U.S.C. 154(b) by 0 days.

(21) Appl. No.: 15/060,943

(22) Filed: Mar. 4, 2016

(65) Prior Publication Data

US 2016/0185525 A1 Jun. 30, 2016

Related U.S. Application Data

(63) Continuation of application No. 13/555,886, filed on Jul. 23, 2012, now Pat. No. 9,309,048.

(Continued)

(51) Int. Cl.
*B65F 1/00* (2006.01)
*B65F 1/16* (2006.01)

(Continued)

(52) U.S. Cl.
CPC ..... *B65F 1/163* (2013.01); *B65F 1/06* (2013.01); *B65F 1/062* (2013.01); *B65F 1/08* (2013.01); *B65F 1/1623* (2013.01); *B65F 7/00* (2013.01); *B65F 2001/1661* (2013.01); *B65F 2210/1023* (2013.01); *B65F 2210/129* (2013.01); *B65F 2230/134* (2013.01); *B65F 2250/112* (2013.01)

(58) Field of Classification Search
CPC .... B65F 1/1426; B65F 1/1436; B65F 1/0073; B65F 1/06; B65F 1/1415; B65F 1/1421; B65F 1/163; F16F 9/30; F16F 9/44; F16F 9/443; F16F 9/0263
USPC ..... 220/495.08
See application file for complete search history.

(56) References Cited

U.S. PATENT DOCUMENTS 2,434,238 A 1/1948 Wolfson
3,008,604 A 11/1961 Garner (Continued)

FOREIGN PATENT DOCUMENTS

GB 772538 4/1957

*Primary Examiner* — Anthony Stashick
*Assistant Examiner* — Ernesto Grano
(74) *Attorney, Agent, or Firm* — Locke Lord LLP

(57) ABSTRACT

Described is a system for controlling the operation of a trash can lid that includes a shell for receiving trash, a lid assembly that covers a portion of the shell, and an actuator assembly that independently controls the rate in which the lid assembly moves with respect to the shell. Also provided is a system for improving the operation of a trash can that includes a lid assembly for covering a portion of a shell, an actuator assembly, a base assembly, and a hydraulic component. The hydraulic component controls the rate in which a portion of the lid assembly moves with respect to the shell. The system further includes an adjustable volume of space that is formed between the base assembly and the removable liner when the removable liner is coupled to the base assembly. The adjustable volume of space can be used to store deodorizers, insecticides, or the like.

14 Claims, 12 Drawing Sheets

Related U.S. Application Data

(60) Provisional application No. 61/553,632, filed on Oct. 31, 2011.

(51) Int. Cl.

| | |
|---|---|
| ***B65F 1/06*** | (2006.01) |
| ***B65F 1/08*** | (2006.01) |
| ***B65F 7/00*** | (2006.01) |

(56) References Cited

U.S. PATENT DOCUMENTS

| | | | | |
|---|---|---|---|---|
| 3,098,703 | A | 7/1963 | Snyder et al. | |
| 3,214,065 | A | 10/1965 | Thornton | |
| 3,840,145 | A | 10/1974 | Almanza | |
| 4,220,228 | A | 9/1980 | Kato | |
| 5,174,462 | A | 12/1992 | Hames | |
| 5,988,520 | A | 11/1999 | Bitner | |
| 6,102,343 | A | 8/2000 | Grimesey et al. | |
| 6,626,316 | B2 | 9/2003 | Yang | |
| 7,077,283 | B2 | 7/2006 | Yang et al. | |
| 7,086,569 | B2 | 8/2006 | Stravitz | |
| 7,225,943 | B2 | 6/2007 | Yang et al. | |
| 7,374,060 | B2 | 5/2008 | Yang et al. | |
| 7,481,329 | B2 | 1/2009 | Camp, Jr. | |
| 7,494,021 | B2 | 2/2009 | Yang et al. | |
| 7,516,865 | B1 | 4/2009 | Pierre | |
| 7,748,556 | B2 | 7/2010 | Yang et al. | |
| 7,922,024 | B2 | 4/2011 | Yang et al. | |
| 2002/0079315 | A1 | 6/2002 | Yang | |
| 2002/0092853 | A1 | 7/2002 | Wang | |
| 2004/0016756 | A1* | 1/2004 | Lin | B65F 1/163 220/263 |
| 2004/0164077 | A1 | 8/2004 | Kuo | |
| 2005/0103788 | A1 | 5/2005 | Yang et al. | |
| 2006/0186121 | A1 | 8/2006 | Yang et al. | |
| 2006/0213910 | A1 | 9/2006 | Yang et al. | |
| 2006/0249510 | A1* | 11/2006 | Lin | B65F 1/163 220/263 |
| 2009/0230131 | A1 | 9/2009 | McDuffie et al. | |
| 2010/0224627 | A1 | 9/2010 | Yang et al. | |
| 2010/0294769 | A1 | 11/2010 | Lee et al. | |
| 2011/0104022 | A1 | 5/2011 | Dunn et al. | |

* cited by examiner

TRASH CAN WITH CUSTOMIZABLE FEATURES

CROSS REFERENCE TO RELATED APPLICATIONS

This nonprovisional patent application claims priority to U.S. Provisional Application No. 61/553,632, filed Oct. 31, 2011.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

This disclosure relates to trash cans and, more specifically, to trash cans having lid actuating mechanisms.

Description of the Related Art

The design of trash cans and, in particular, trash cans with actuating assemblies that can raise and lower the lid provides several challenges that have not been optimally addressed with present designs.

For example, one of the challenges that exists with respect to trash cans with lid actuating elements is stability and strength. Often the actuating designs are constructed in such a way that the lid actuating elements either detract or do not enhance the stability of the overall trash can. Moreover, such lid actuating elements typically employ the use of movable elements and the existence of an unstable actuator can result in a trash can having an appearance suggesting the can was poorly manufactured or inadequately designed. Moreover, relative movement of the various elements in such an actuator with respect to one another can give rise to unwanted noise.

As an example, U.S. Pat. No. 7,077,283 discloses a trash can assembly in which a lid actuator utilizes a single, upwardly extending rod. The use of a single rod provides little structural support for the trash can and, moreover, provides essentially no support against a relative twisting movement of the can. A further limitation of lid actuators utilizing only a single rod element is that they either place uneven stresses on actuating elements, such as a foot pedal, or they are connected to a single point on such an actuator, such that all stresses are concentrated on one area of the pedal. Such concentrated stresses can result in damage or breakage of the pedal.

In an apparent effort to overcome the localization of the stresses created when a single rod is used, lid actuator assemblies have been developed that utilize two rods. As one example, U.S. Pat. No. 7,922,024 discloses a trash can with a lid actuating element including two non-connected upwardly extending rods, each extending upwardly at an angle and each upwardly extending at an angle with respect to each other. This arrangement allows the rod members to easily move relative to each other, thus giving rise to the perception and noise issues described above. Moreover, because the rod members can move independently, they provide essentially no support against twisting movement of the can. Furthermore, the angle at which the rods extend upwardly prevents the rods from providing any meaningful structural support. Similar issues exist, for example, with respect to the trash can design reflected in U.S. Pat. No. 7,374,060.

A further issues with the conventional dual rod actuator assemblies is that they often require complicated hinging mechanisms and/or hinging mechanisms that are relatively large when compared to the overall size of the trash can. Such relatively large hinging mechanisms can increase the overall material cost of a trash can and can provide more points of potential failure and can give rise to both aesthetic and size issues. For example, Published United States Patent Application US 2010/0224627 discloses a trash can with a dual rod lid actuator assembly that requires a relatively complex hinging arrangement.

Another challenge facing trash can designers and, in particular, designers of trash cans with lid actuators is obtaining desired performance from the trash can. In particular, some users want the can lid to open quickly and close slowly. Others want the can lid to open slowly and close quickly and still others want the lid to open and close slowly. Yet others may want to attach odor control devices on the lid and need to accommodate the increased load when opening and closing the trash can lid. In order to address these issues it is known to use dampening members in connection with lid actuator assemblies. Such dampening members are typically secured and stabilized with respect to the other components of the trash can such that, once they are installed, they cannot be easily replaced or adjusted. For example, U.S. Pat. No. 7,922,024 discloses a trash can with a dampening member that is stabilized with respect to a lower portion of the trash can such that, once the trash can is assembled, it cannot be removed or adjusted. The same problem exists with respect to U.S. Pat. No. 7,494,021.

Yet another problem facing trash can designers is the need for the user to properly position and self-center any liner member contained within a shell. Many trash can designs require the use of a liner and the positioning of a liner within an outer shell. Such arrangements often require the user to manipulate the liner so as to avoid having the liner "catch" or rest on intermediate structures within the trash can in such a manner that the lid cannot close. For example, U.S. Pat. No. 7,077,283 discloses a trash can having a block upon which the liner may catch preventing closure of the trash can.

A further problem of the use of liners placed within shells, is that the liners typically rest on a base structure such that there is no, or very limited, airflow across the base structure. This absence of airflow can create a closed environment in which trash or waste can decay and or fester giving rise to visibly unpleasant odors and/or growth.

Still other problems exist with respect to conventional trash can designs that are overcome by the novel invention disclosed herein.

BRIEF SUMMARY OF THE INVENTION

Described is a system for controlling the operation of a trash can lid that includes a shell for receiving trash, a lid assembly that covers a portion of the shell, and an actuator assembly that independently controls the rate in which the lid assembly moves with respect to the shell. Also provided is a system for improving the operation of a trash can that includes a lid assembly for covering a portion of a shell, an actuator assembly, a base assembly, and a hydraulic component. The hydraulic component controls the rate in which a portion of the lid assembly moves with respect to the shell. The system further includes an adjustable volume of space that is formed between the base assembly and the removable liner when the removable liner is coupled to the base assembly. The adjustable volume of space can be used to store deodorizers, insecticides, or the like.

The disclosure provides a system for controlling the operation of a trash can lid that can include a shell that can be adapted to receive trash, a lid assembly that can be adapted to cover at least a portion of the shell, and an actuator assembly that can independently control the rate in which a portion of the lid assembly moves with respect to the shell. The rate in which a portion of the lid assembly moves away from the shell can be different than the rate in which a portion of the lid assembly moves towards the shell.

The system's actuator assembly can further include a hydraulic component that can be adapted to adjust the rate in which a portion of the lid assembly moves with respect to the shell. The hydraulic component can further be adapted to adjust the rate in which a portion of the lid assembly moves with respect to the shell through a manipulation of the hydraulic component.

The system can further include a weighted element that can be adapted to be coupled to the lid assembly, an elastic device that can be adapted to be coupled to the lid assembly, or both. The weighted element and the elastic device can be adapted to increase the rate in which a portion of the lid assembly moves towards the shell.

The disclosure also provides a system for improving the operation of a trash can that can include a lid assembly that can be adapted to cover at least a portion of a shell, an actuator assembly, a base assembly, and a hydraulic component. The hydraulic component can be adapted to be coupled to the base assembly and the actuator assembly. The hydraulic component can further be adapted to control the rate in which a portion of the lid assembly moves with respect to the shell.

The system can further include a mount adapted to couple the hydraulic component to the base assembly. The mount can further include a quick-release pin to facilitate the decoupling of the hydraulic component from the base assembly. The actuator assembly can further include at least two actuator rod members that can each be coupled to an actuator brace. The actuator brace can prevent each rod member of the at least two rod members from moving independently with respect to each other.

The system can further include a removable liner that can be adapted to be coupled to a shell. The removable liner can include a section that can be adapted to enhance a user's ability to remove the liner from the shell. The base assembly can further include a pedal and a pedal stop that can be adapted to prohibit the pedal from contacting a surface disposed beneath the base assembly.

The disclosure also provides a system for improving the operation of a trash can that can include a shell that can be adapted to receive trash, a removable liner that can be adapted to be coupled to the shell, and a base assembly that can be adapted to support the shell.

An adjustable volume of space can be formed between the base assembly and the removable liner when the removable liner is coupled to the base assembly. The adjustable volume of space formed between the base assembly and the removable liner can be adapted to receive a liquid absorbing material, a deodorizer, an insecticide, a pest repellant, or a box of trash bags. The system can further include at least one pedestal element adapted to be coupled to the base assembly, the removable liner, or both. The system can further include a shell cavity ring that can be adapted to be coupled to the shell and further adapted to support the weight of the removable liner.

BRIEF DESCRIPTION OF THE SEVERAL VIEWS OF THE DRAWINGS

The foregoing and other advantages of the disclosed embodiments will become apparent from the following detailed description and upon reference to the drawings, wherein.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Described is a system for controlling the operation of a trash can lid that includes a shell for receiving trash, a lid assembly that covers a portion of the shell, and an actuator assembly that independently controls the rate in which the lid assembly moves with respect to the shell. Also provided is a system for improving the operation of a trash can that includes a lid assembly for covering a portion of a shell, an actuator assembly, a base assembly, and a hydraulic component. The hydraulic component controls the rate in which a portion of the lid assembly moves with respect to the shell. The system further includes an adjustable volume of space that is formed between the base assembly and the removable liner when the removable liner is coupled to the base assembly. The adjustable volume of space can be used to store deodorizers, insecticides, or the like.

Figure 1A:
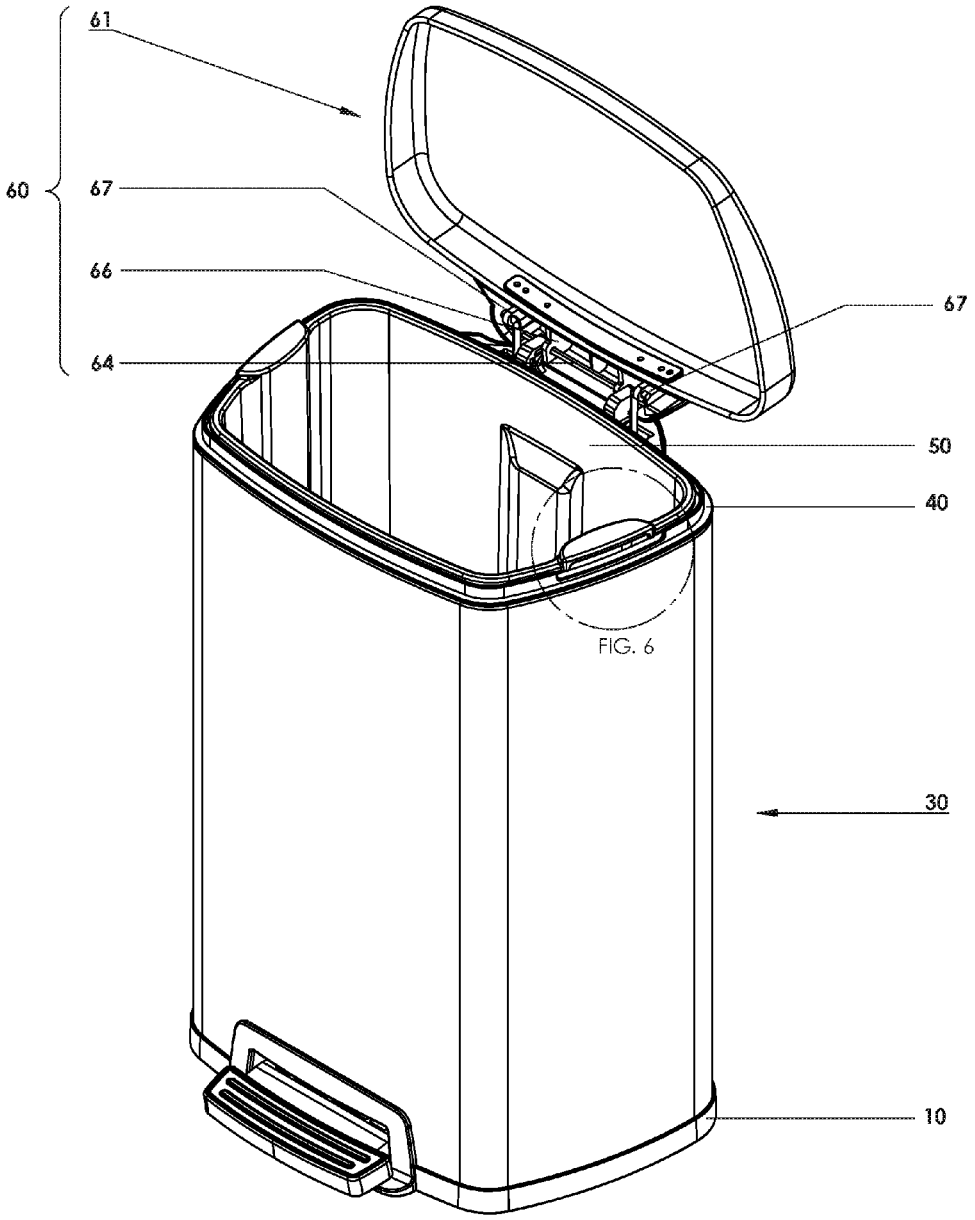
FIG. 1A illustrates a front perspective view of a trash can according to one embodiment of the present invention shown with the lid in the open position.
Figure 1B:
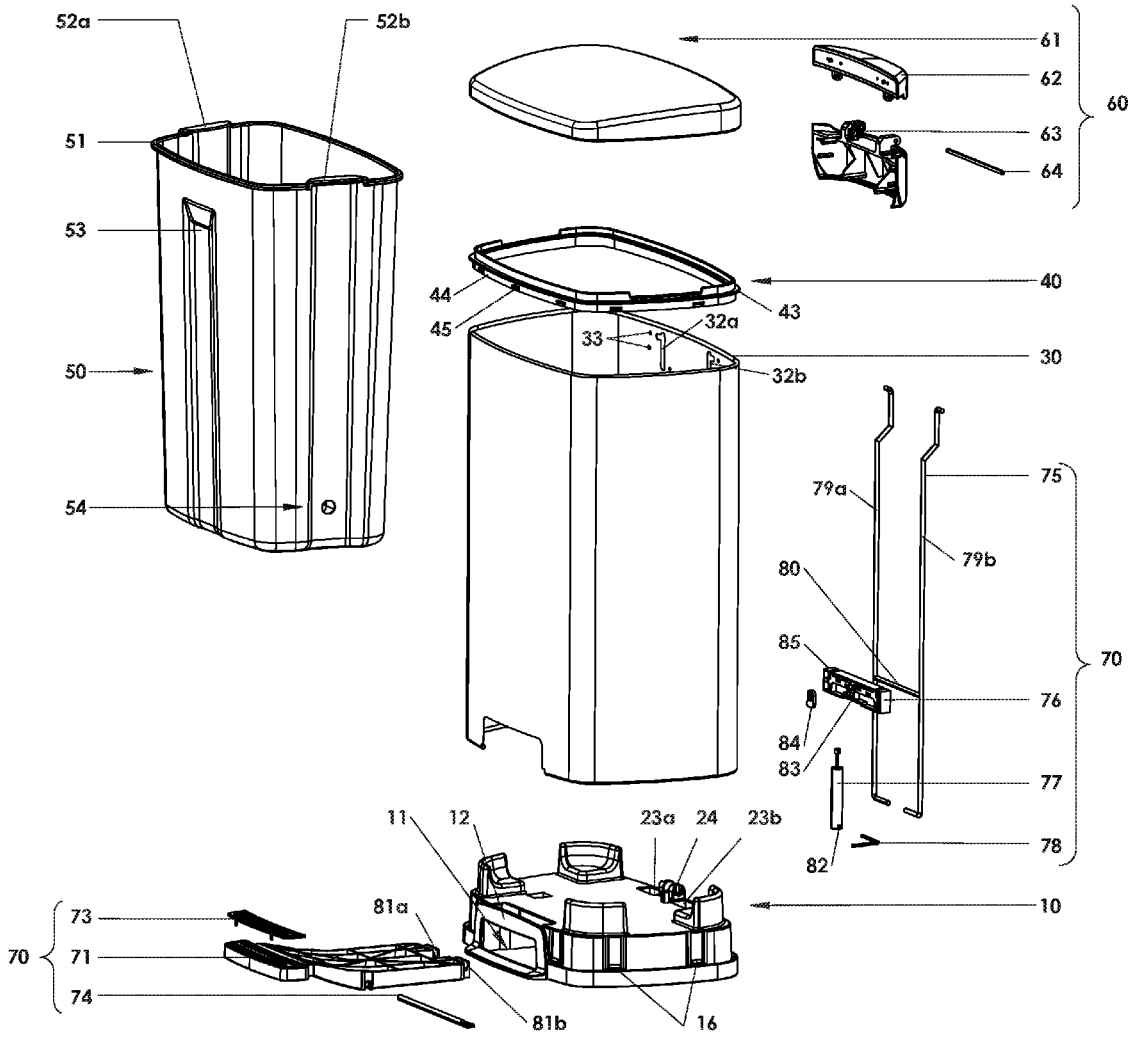
FIG. 1B illustrates an exploded front perspective view of a trash can according to one embodiment of the present invention, further illustrating the components of the base assembly and components, the actuator assembly and components, and the lid assembly and components, as well as the liner and trim ring.

Turning to the drawings and, in particular, to FIGS. 1A and 1B, a first exemplary embodiment of an improved trash can 100 is illustrated. FIG. 1A shows the trash can 100 as assembled and FIG. 1B provides an exploded view of the assembled trash can 100.

As reflected in the figures, the exemplary trash can 100 include: (i) a base assembly 10; (ii) a shell 30; (iii) a trim ring 40; (iv) a liner 50; (vi) a lid and hinge assembly 60 and (vi) an actuator assembly 70. As shown in FIG. 1B, the lid and hinge assembly 60 includes a lid 61, a lid hinge 62, a hinge bracket 63 and a hinge retaining pin 64. As reflected in the same figure, the exemplary actuator assembly 70 includes a pedal 71, a pedal plate 73, a pedal retaining pin 74, an actuator rod assembly 75, an actuator brace 76, a hydraulic cartridge 77, and a quick-release pin 78.

As reflected in FIG. 1A, when assembled, the base assembly 10 rests on a floor surface and provides a base for the trash can 100. The shell 30 rests on the base assembly 10 and defines an upper surface and an interior space. The trim ring 40 rests on the top of shell 30. The liner 50 rests on the trim ring 40 and is positioned within an interior space defined by the shell 30.

In the example trash can 100 of FIG. 1A and FIG. 1B, the hinge bracket 63 of the lid and hinge assembly 60 is coupled to a rear surface of the shell 30 and the lid hinge 62 is coupled to the lid 61. The hinge bracket 63 is coupled to the lid hinge 62 via the hinge retaining pin 64 in such a manner that the lid hinge 62 may pivot relative to the hinge bracket 63 about the hinge retaining pin 64. The pedal 71 is movably coupled to the actuator rod assembly 75 and the actuator rod assembly is coupled to the lid hinge 62 in such a manner that actuation of the actuator assembly 70 (by depressing the pedal 71) results in the opening of the lid 61 to allow access to the interior of trash can 100. In the illustrated example, the hydraulic cartridge 77 dampens both the opening and the closing of the lid 61.

The exemplary trash can 100 depicted in FIGS. 1A and 1B includes several advantageous features.

As one example, the formation of the base assembly 10 is such that the trash can 100 provides a beneficial coupling between the base assembly 10 and the shell 30. This feature of the base assembly 10 is reflected generally in FIG. 1A and, in more detail, in FIGS. 2A, 2B, and 2C.

As reflected in FIG. 1B and FIGS. 2A-2C, the exemplary base assembly 10 is generally rectangular in shape and defines an open inner region (not labeled) and an opening 11 that is sized to receive the pedal 71. A outward frame member 12 (which may be integrally formed with the base assembly 10, extends about the opening 11. The top portion of frame member 12 defines an upwardly extending tab 13 and a spaced gap 14 between the tab 13 and the frame member 12. In addition, in the example, the outer surface of the base assembly 10 defines a receiving channel 15 that is shaped and sized to receive the bottom surface of the shell 30. Periodically located about the outer surface are guiding and locking members 16, each of which is formed from an indented segment and an outwardly projecting ramp. In use, as the shell 30 is positioned over the base assembly 10, the lower portion of the shell 30 will slide over the base assembly 10 and the guiding and locking members 16 will guide the shell 30 in place such that the bottom portion of the shell is received within the receiving channel 15 and such that the projections on the guiding and locking members 16 will tend to hold the shell 30 in place. Additionally, the tab 13 and the spaced gap 14 are arranged such that, when the shell 30 is positioned over the base assembly 10, a portion of the shell will be held between the tab 13 and a portion of the frame member 12. The above-described arrangement helps hold the shell 30 in a fixed position relative to the base assembly 10.

In addition to providing a beneficial coupling with the shell 30, the base assembly 10 of the illustrated embodiment provides a beneficial mechanism for coupling the pedal 71 and the base assembly 10. In particular, the opening 11 of the base assembly 10 is shaped and sized to receive the pedal 71. As reflected in FIG. 2C, the base assembly 10 further defines a feature 17 adapted to receive the pedal retaining pin 74 and to couple the pedal 71 to the base assembly via the pedal retaining pin 74. When so coupled, the pedal 71 is able to pivot about the pedal retaining pin 74 relative to the base assembly 10. Also as reflected in FIG. 2C, the base assembly 10 further defines a horizontally-extending lower pedal stop 18 against which the lower surface of the pedal 71 rests when the pedal is depressed. The lower pedal stop 18 is beneficial, among other things, to strengthen the pedal assembly and protect the pedal from excessive downward or lateral forces. In addition, the pedal stop 18 prevents contact between the pedal 71 and the surface on which the trash can is placed. When the trash can 100 is placed on a carpeted or otherwise textured surface it tends to prevent the lower portion of the pedal from becoming entangled with the surface upon which the trash can is placed. When placed on a hard supporting surface, the lower pedal stop 18 can also provide a buffer surface to prevent the lower portion of the pedal from contacting the hard supporting surface and, potentially, creating undesired noise, damaging the pedal 71 or, in some instances, marring the floor surface.

Yet another advantage of the base assembly 10 of exemplary trash can 100 is that, in conjunction with liner 50, it provides both an beneficial air space feature and a self-alignment feature. As best reflected in FIG. 2A, the base assembly 10 further defines four pedestal elements 19*a*, 19*b*, 19*c*, and 19*d*. Each of the pedestal elements is generally "chair-shaped" and defines a base portion 20 and an back portion 21. Only the base portion 20 and back portion 21 for pedestal element 19*a* are labeled.

Figure 2A:
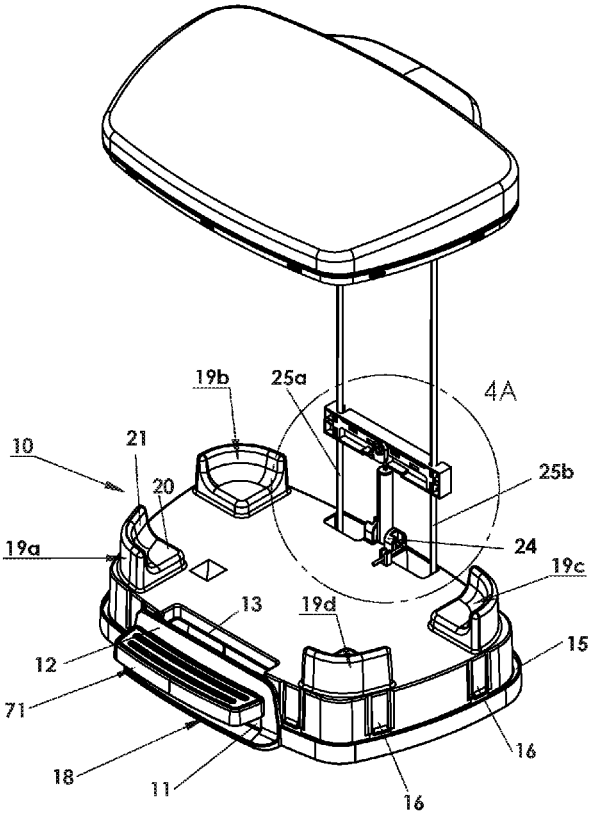
FIG. 2A illustrates a skeleton front perspective view of the base assembly, actuator assembly, and lid assembly of a trash can according to one embodiment of the present invention.

As shown in FIG. 2A, each pedestal element 19*a*-19*d* defines an interior seat that is curved both in the horizontal and vertical directions. As apparent from the drawings, the combined seating portions of the pedestal elements 19*a*-19*d* define a seating surface that is sized and shaped to receive the bottom of the liner 50. In the illustrated embodiment, the base of the liner 50 is formed such that the bottom corners of the liner 50 are curved both in the horizontal and vertical directions. The curves defined by the bottom of the liner 50 are designed to generally match the curves defined by the seating surfaces of the pedestal elements 19*a*-19*b* such that, as the liner 50 is lowered into position on the base assembly 10, the matching curves will result in proper, automatic alignment of the liner 50 and the base assembly 10.

In addition to enabling the self-aligning feature described above, the special shape of the pedestal elements 19*a*-19*d* ensures that, when the liner 50 is positioned on the base assembly 10, a defined air space or void exists underneath the liner 50. This is reflected generally in FIG. 2C where the air space 22 defined in such a situation is depicted. The provision of the air space 22 allows for the trash can 100 to incorporate several optional features. For example, in certain applications odor control may be an issue and the air space 22 can be used to provide space for the placement of odor masking agents and/or scented agents. In other examples, where there is a concern about spillage or leakage of liquid materials, the air space 22 may be used to store a liquid receiving mat or liquid absorbing materials.

Figure 3A:
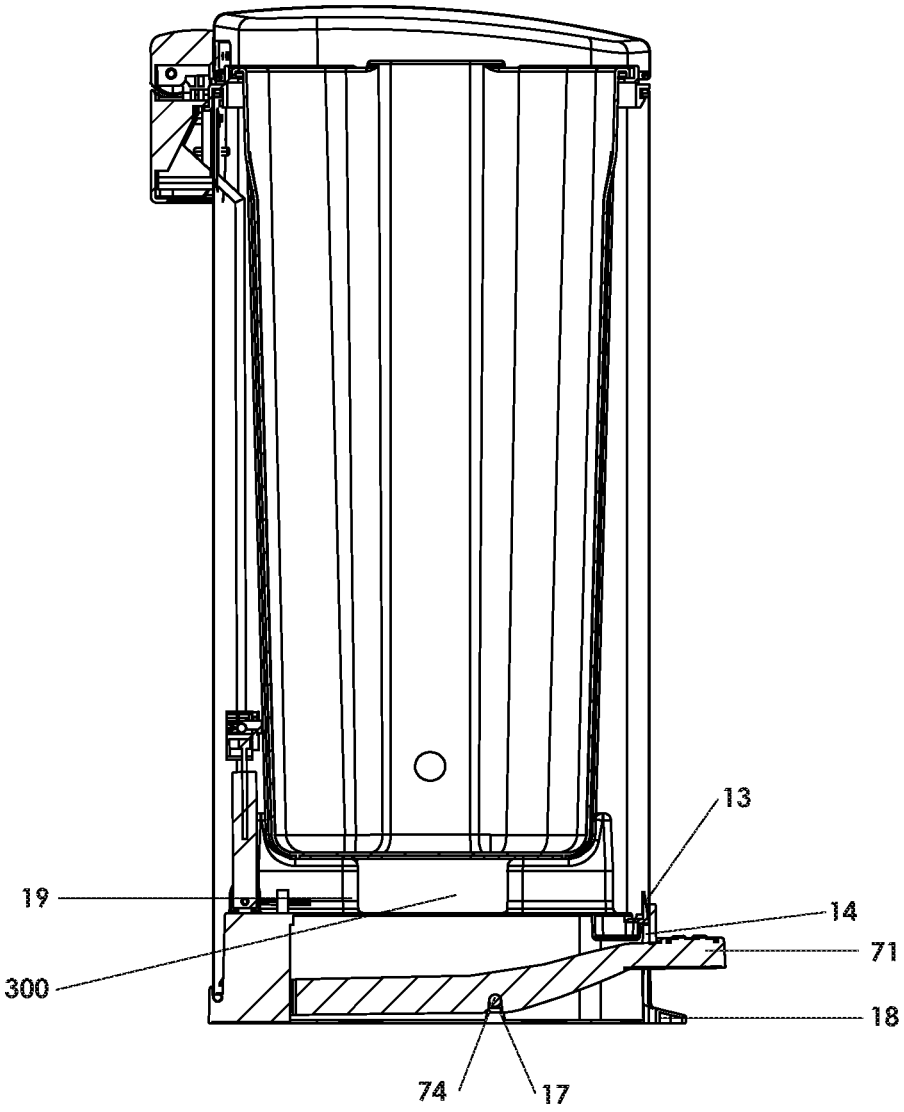
FIG. 3A illustrates a cross-sectional side view of a trash can according to one embodiment of the present invention showing the storage space of the base assembly containing trash bags.
Figure 3B:
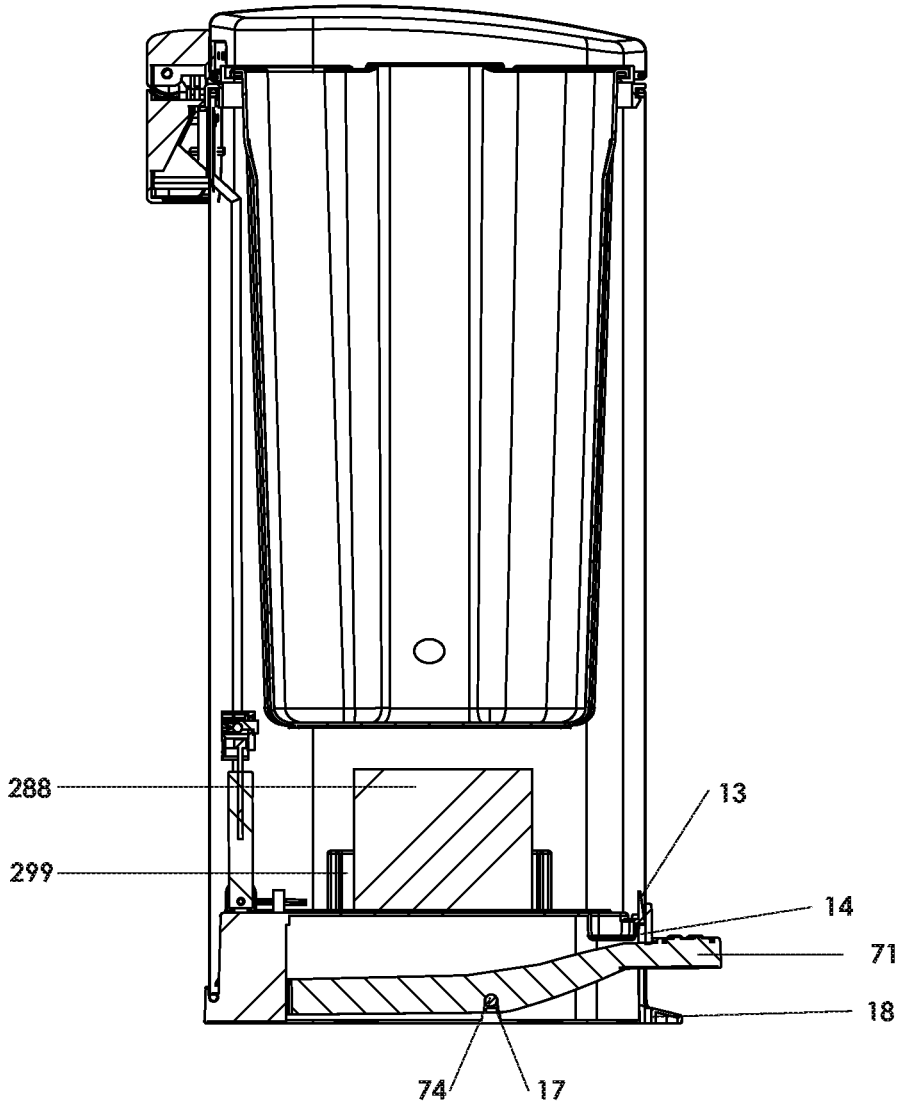
FIG. 3B illustrates a cross-sectional side view of a trash can according to an alternate embodiment of the present invention showing the storage space of the base assembly sized sufficiently large to accommodate a box of trash bags.

In still other exemplary applications, where a can bag will be used with liner 50, the air space 300 can be enlarged by increasing the height of pedestal elements 19 so that air space 300 can be used to store replacement bags, as depicted, for example, in FIG. 3. In still other embodiments, the liner 50 can be decreased in size to provide a sufficiently large air space 301 such that a box of trash bags 288 can be stored in the trash can, as shown in FIG. 3B. In such an embodiment, the liner 50 is supported by the trim ring 40 and the pedestal elements 19 are replaced by containment elements 299 that keep the box of trash bags 288 in place. While not depicted in FIG. 3B, containment elements 299 can be made to be adjustable in placement and size, as would be understood by a person of skill in the art. Finally, in embodiments where pests or insects may be an issue, the air space 22 may be used to store an insecticide or pest repellant. A further benefit of the air space 22 is that it enables airflow over the portion of the base assembly 10 underneath the liner 50 such that any spilled liquids have an opportunity to dry rather than to form pools within which materials may grow.

As still further advantage of the illustrated base assembly 10 is that it forms an interface between the base assembly 10 and the actuator assembly 70 that can include a quick-release mount for hydraulic cartridge 77 (an optional part of the actuator assembly 70), thus enabling efficient construction and enabling rapid adjustment in the operating characteristics of the exemplary can.

Referring first to FIG. 1B, it may be noted that the actuator assembly includes a number of components including an actuator rod assembly 75 that is formed from several pieces of steel wire that have been cut, bent, and spot-welded to form an actuator rod assembly 75 that includes two upstanding rod members 79*a* and 79*b* and a supporting cross-bar member 80. The rod members 79*a* and 79*b* are inwardly-bent at the bottom to define substantially "L-shaped" portions. In the illustrated example, the top portions of rod members 79*a* and 79*b* are bent both rearwardly and outwardly to enable effective coupling to the lid and hinge assembly 60 as described in more detail below. Of note, in the illustrated example, the rod members 79*a* and 79*b* extend substantially parallel to one another and extend upwardly in a substantially vertical manner. This parallel-vertical arrangement is very robust and provides a strong support structure for the actuator assembly 70 and for the entire trash can 100. When this parallel, vertical arrangement is coupled with the added support of the cross-bar member 80, a strong, solid actuator structure is formed.

Openings 23*a* and 23*b* are defined by the base assembly 10 and are sized and shaped to allow the bottom ends of the rod members to pass into the interior space defined by the base assembly 10. Within the interior space, the bottoms of the rod members 79*a* and 79*b* engage receiving seats 81*a* and 81*b* formed at the end of pedal 71. In the illustrated embodiment the receiving seats 81*a* and 81*b* of pedal 71 are substantially U-shaped troughs, sized such that the L-shaped ends of rod members 79*a* and 79*b* may be received and held within the troughs without the need for additional retaining hardware and without the need for specialized manufacturing tooling. Moreover, because there are no hardware elements holding the ends of the rod members 79*a* and 79*b* within the pedal 71, the rod members 79*a* and 79*b* may be easily removed and replaced for repair or cleaning.

In addition to defining openings 23*a* and 23*b*, the base assembly 10 also defines a quick-release pivot mount 24, that is generally illustrated in FIG. 1B and is illustrated in more detail in FIG. 2A and FIG. 3A. As best reflected in FIG. 2A and FIG. 4A, the quick-release pivot mount 24, in the illustrated exemplary embodiment, is formed from two-upwardly rising support columns 25*a* and 25*b*. In the illustrated example, each of the support columns defines a receiving hole sized and shaped such that it can receive a portion of the cartridge quick release pin 78. Alternate embodiments are envisioned where one of the support columns, e.g., support column 25*a* is does not define a receiving hole but rather defines a receiving element (such as an indented portion or "cup-like" element that is adapted to receive an end of the quick-release pin 78).

In addition to including the supporting columns 25*a* and 25*b*, the quick-release pivot mount 24 also defines a snap-receiver 26 for receiving one end of the cartridge quick release pin 78 in a "snap-fit" engagement such that the relevant end of the pin 78 may be snapped in and out of the receiver (again without the need for any additional supporting hardware or tools). Through the use of the above-described structure, the quick release pin 78 may be efficiently and quickly positioned in a fixed relationship with the base assembly 10 (when the pin 78 is positioned through the support columns 25*a* and 25*b* and one end is snapped into the receiver 26). In the same sense, the quick-release pin 78 may be quickly and easily adjusted and removed from the base assembly 10. The use of the quick-release pivot mount 24 allows for the effective and efficient coupling of one end of hydraulic cartridge 77 to the base assembly 10.

As reflected in FIG. 1B, in the illustrated example, the hydraulic cartridge 77 is formed such that it has a defined opening 82 passing through the bottom of the cartridge 77. In the illustrated embodiment, the opening is sized and shaped such that the cartridge quick release pin 78 can pass through it and such that the hydraulic cartridge 77 can pivot about the pin 78 when so positioned. This particular arrangement allows for a quick coupling of the hydraulic cartridge 77 to the base assembly 10 in the manner depicted in FIG. 4A.

Figure 4A:
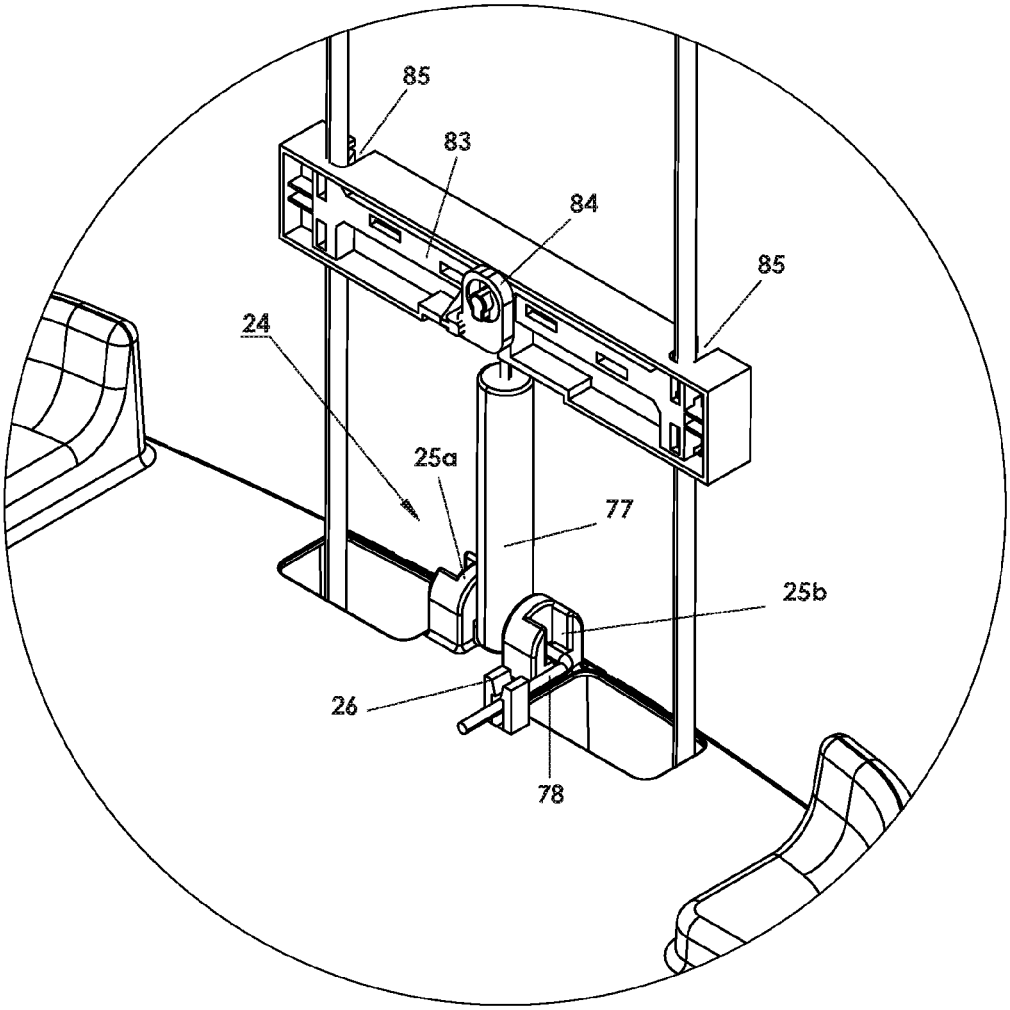
FIG. 4A illustrates a detail of a perspective view of the pivoting hydraulic cartridge and the quick-release pivot mount as attached to the actuator assembly.
Figure 4B:
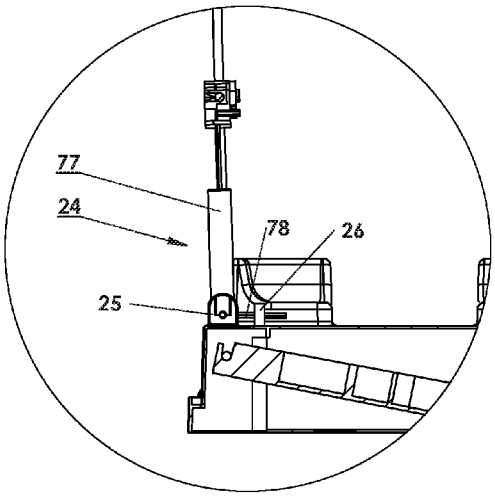
FIG. 4B illustrates a cross-sectional side view of a trash can in accordance with one embodiment of the present invention illustrating the lid in an open position and an example of an accompanying pivot position of the hydraulic cartridge.
Figure 4C:
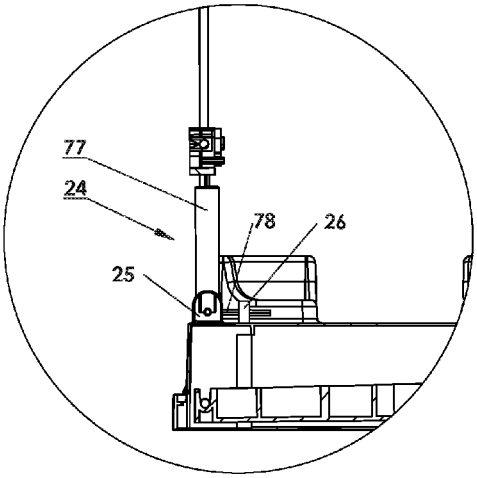
FIG. 4C illustrates a cross-sectional side view of a trash can in accordance with one embodiment of the present invention illustrating the lid in a closed position and an example of an accompanying pivot position of the hydraulic cartridge.

When the hydraulic cartridge 77 is coupled to the base assembly 10 using the quick-release pivot mount 24 as shown in FIG. 4A, the hydraulic cartridge 77 is coupled to the base assembly 10 in a pivotable relationship such that it is not secured and stabilized to the base assembly 10. On the contrary, the specific coupling described above allows for relative movement between the hydraulic cartridge 77 and the base assembly such that the hydraulic assembly can—and as described below—move, tilt and pivot relative to the base assembly during normal operation of the trash can 100. An exemplary pivoting range of the hydraulic cartridge 77 that occurs when the main lid 61 is in the opened and closed position is illustrated in FIGS. 4B and 4C.

The ability of the hydraulic cartridge 77 to pivot as the main lid 61 is opened and closed avoids possible jamming of the actuator assembly 70 because the hydraulic cartridge 77 rotates with the actuator rod members 79*a* and 79*b* so that the hydraulic cartridge 77 and the actuator rod members 79*a* and 79*b* remain parallel through the open and close cycle. Further, the load of the weight of the lid and hinge assembly 60 is maintained directly on top of the actuator rod members 79*a* and 79*b* when the main lid 61 is moved from an open to closed position and a closed to open position, further aiding in the removal of lateral or side loads that may contribute to jamming of the lid and hinge assembly 60. As a result of the reduction in lateral loads, wear on the hydraulic cartridge 77 is reduced because the rubber seals in the hydraulic cartridge 77 are not side-loaded during use. A further benefit of the pivoting ability of hydraulic cartridge 77 is the contribution to the ease of operation of the lid and hinge assembly 60.

Referring back to FIG. 1B, it may be seen that the exemplary trash can 100 further includes an actuator brace 76. In the illustrated embodiment, the actuator brace 76 is formed of molded plastic and is further formed to have indented notches 85 on one side such that it may be pressed onto the actuator rod assembly 75 in such a manner that it engages both the actuator rod members 79*a* and 79*b* and the cross-bar member 80. As with the quick release pin 78 and the coupling between the pedal 71 as described above, this use of snap-fitting notches allows for effective and efficient assembly and disassembly of the actuator assembly 70 without the need for tools.

The actuator brace 76 includes a cavity 83 and a pivoting cover 84 (best seen in FIG. 4A). The cavity 83 is sized and shaped to receive the top end of the movable piston within the hydraulic cartridge 77. The pivoting cover 84 may be pivoted from an open to a closed position such that it can enable access to cavity 83 (when open) or securely-cover the cavity 83 when closed. The use of this pivoting cover allows for insertion of the top portion of the hydraulic cartridge 77 into the cavity 83 and a coupling of the end of the hydraulic cartridge 77 to the actuator brace 76. The coupling, however, may be quickly-released by moving the cover 84 to an open position and removing the hydraulic cartridge.

In the illustrated embodiment, the cover 84 is depicted as a pivoting element that is attached to the actuator brace 76 by a screw. Other embodiments are envisioned where other means of attachment (e.g., a press-fit snap) are used to couple the cover 84 to the actuator brace 76 and still other embodiments are envisioned where the cover 84 is replaced with a sliding element to provide access to the cavity 83 and to cover the cavity. Still further embodiments are envisioned wherein the cover 84 is eliminated in its entirety and the top portion of the hydraulic cartridge is snapped or pressed into the cavity 83 in such a manner that it can be removed with the provision of adequate force.

As described in more detail below, the coupling described above is such that, when the trash can 100 is positioned on a support surface, such as a floor, and the pedal 71 is depressed, the pedal 71 will act against the rod assembly 75 causing it to move upward and the rod assembly 75 will tend to move downward when the pedal 71 is released. This results in opening and closure of the lid and hinge assembly 60. Because of the use of the quick-release mounts described above, and the optional hydraulic cartridge 77, the specific manner in which the rod assembly 75 moves can be controlled and adjusted to suit a variety of applications.

For example, in some applications standard opening and closing of the lid assembly will be desired. In such applications, one can customize trash can 100 by not employing the hydraulic cartridge 77 and simply allowing the lid and hinge assembly 60 to open and close through standard operation of the trash can 100.

In other applications, it may be desirable to close the lid and hinge assembly 60 as quickly as possible and to place a closing force on the lid and hinge assembly 60 to keep it closed. In such applications, one may be able to place a closing force on the lid assembly by, for example, coupling a weighted element (not illustrated in the figures) to the brace 76 using the same coupling mechanism described above in connection with the hydraulic cartridge 77. Such a weighted element can serve to place a downward force on the actuator assembly 70, thus tending to close the lid and hinge assembly 60 and to provide a force tending to keep the lid and hinge assembly 60 in the closed position.

In yet other applications, it may be desirable to place odor control devices such as filters or air fresheners under or on the lid 61. The additional weight of such optional odor control devices will require the use of a hydraulic cartridge 77 that is tuned to withstand the greater load resulting from such optional odor control devices.

In yet another embodiment, an elastic device, such as a large elastic band or a corded group of bands could be coupled to the quick-release pivot mount 24 of base assembly and to the actuator brace 76 to provide a force that would tend to result in prompt closure of the lid and hinge assembly 60. In such embodiments, the actuator brace 76 may be eliminated as the elastic element could be placed around or over the cross-bar member 80.

In still further embodiments, it may be desirable to provide a smoothly opening and smoothing closing lid assembly. In such embodiments, a hydraulic actuator 77 may be used that tends to gradually oppose movement in both directions of the actuator assembly 70. In such embodiments, therefore, both the upward and downward movement of the rod assembly will be opposed by the hydraulic cartridge 77 and the trash can will have smooth opening and closing operating characteristics.

In embodiments where a hydraulic cartridge 77 is used, the operating characteristics of the hydraulic cartridge 77 may be tailored to the specific application. For example, in some applications it will be desirable to have the hydraulic cartridge 77 provide equal opposing forces to both the upward and downward movement of the actuator brace 76. In still other applications, it may be desirable to have the opposing force be greater on one direction or the other. In such applications, different hydraulic cartridges 77 may be provided for each desired operating mode. Alternately, an adjustable hydraulic cartridge 77 may be provided where a twisting of a pin or other member can be used to adjust the operating characteristic of the device. Because of the use of the quick-release pivot mounts 24 described above, replacement or removal of the hydraulic cartridge 77 is simple and straightforward and, as such, it is relatively east to "tune" the operation of trash can 100 to the desired operating characteristics of the user.

Referring back to FIGS. 1A and 1B, it may be noted that, when fully-assembled, the shell 30 is positioned over the base assembly as described above. The shell 30 may be formed from any suitable material and, in the illustrated embodiment, is formed of stainless steel. As best reflected in FIGS. 1A and 1B, the rear portion of exemplary shell 30 defines slots 32*a* and 32*b* sized and shaped such that the top portions of rod members 79*a* and 79*b* can pass there through. The shell 30 also defines several mounting holes 33 (only some of which are labeled in FIG. 1B) to allow coupling between the shell 30 and the lid and hinge assembly 60.

As depicted generally in FIG. 1B and in more detail in FIG. 1A, the lid and hinge assembly 60 includes a main lid 61 and upper lid hinge 62. The upper lid hinge 62 defines first receiving members 66 sized and shaped to receive the hinge retaining pin 64 and second receiving members 67 sized and shaped to receive the top portions of the rod members 79*a* and 79*b*. When assembled the upper lid hinge 62 is coupled to the main lid 61 through the use of screws, bolts, snap elements, or other suitable mounting hardware. The upper lid hinge 62 is also pivotally coupled to the main hinge bracket 63 through the use of the hinge retaining pin 64. As reflected in FIG. 1A, this coupling allows the upper lid hinge 62 to pivot about the hinge retaining pin 64 relative to the main hinge bracket 63. The pivoting portions of the upper lid hinge 62 is enclosed in the main hinge bracket 63 so that all hinge connection points are hidden from view behind the main hinge bracket 63.

In the specific example of FIGS. 1A and 1B, the rod members 79*a* and 79*b* extend to an interior portion of the upper lid hinge 62 and are coupled to the upper lid hinge 62 through outwardly extending (or left and right extending, when facing the can) portions. In addition, the coupling is such that the pivoting connection between the upper lid hinge 62 and the main hinge bracket 63 is "within" the interior connections of the rod members 79*a* and 79*b* and the upper lid hinge 62. In other words, the connection between the upper lid hinge 62 and the actuator rod members 79*a* and 79*b* bracket the connection between the upper lid hinge 62 and the main hinge bracket 63. This specific coupling arrangement allows for the rod members to be maintained in the parallel-vertical arrangement discussed above and also allows the overall profile of the hinge portion of the lid and hinge assembly 60 to be reduced which is beneficial from an aesthetic and materials standpoint. The specific coupling arrangement also allows for a relatively large width of upper lid hinge 62, thereby contributing to stability of the lid 61 and the lid and hinge assembly 60. While not required to practice the inventions disclosed herein, the upper lid hinge 62 should ideally be at least thirty-five percent (35%) of the width of the lid 61.

Figure 2B:
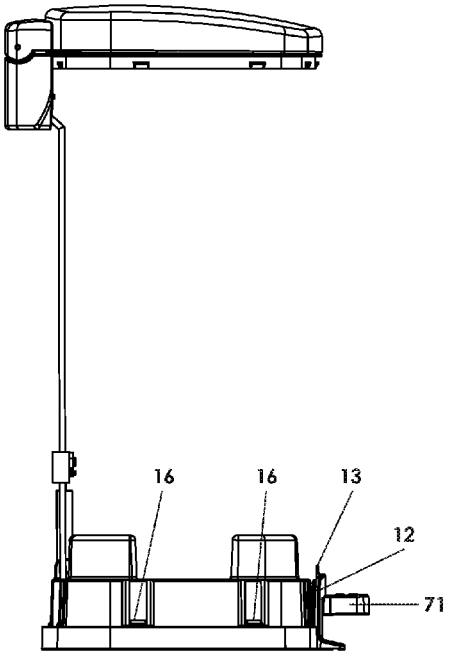
FIG. 2B illustrates a side view of the base assembly, actuator assembly, and lid assembly of a trash can according to one embodiment of the present invention.
Figure 2C:
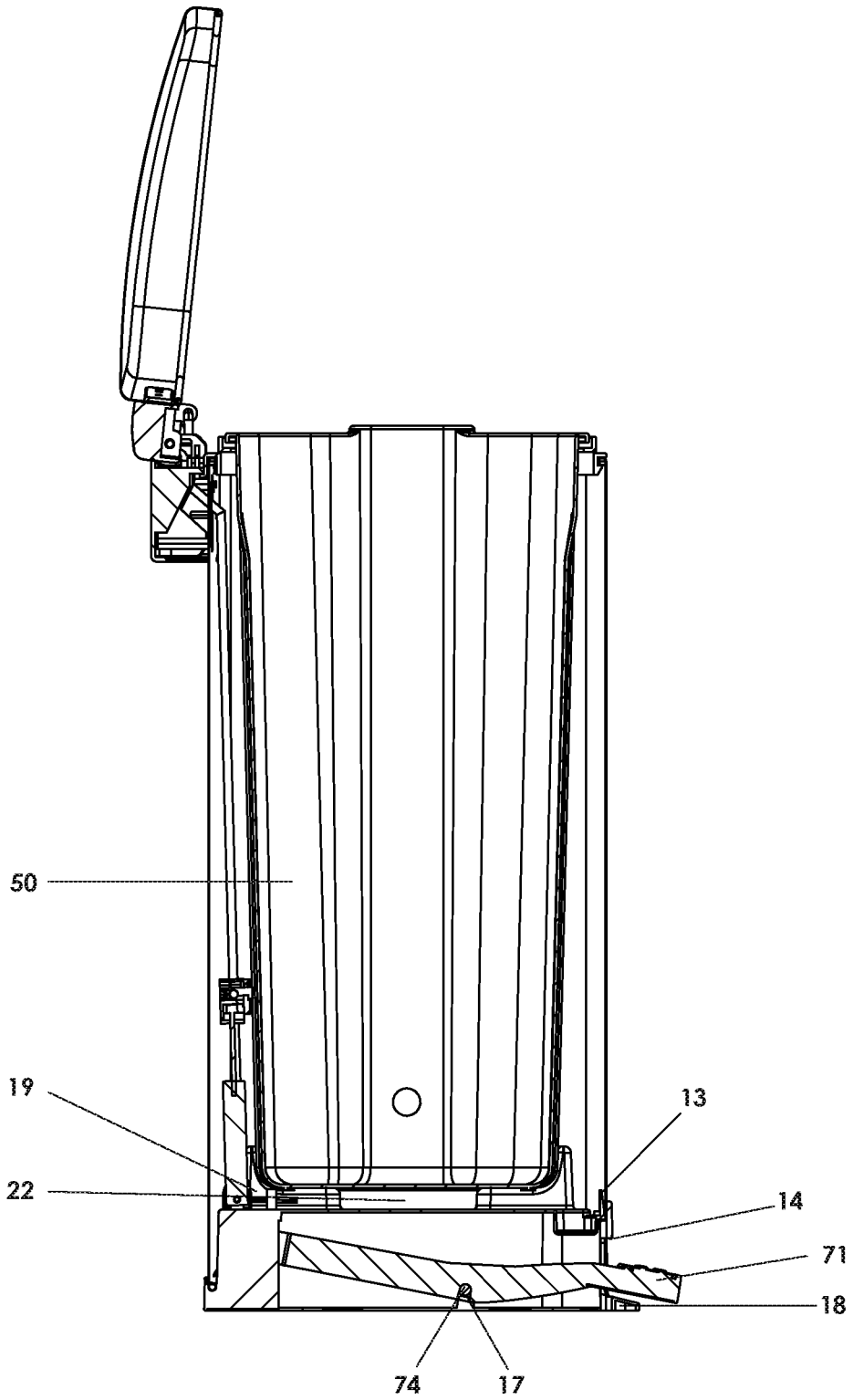
FIG. 2C illustrates a cross-sectional side view of a trash can according to one embodiment of the present invention showing a positioning of the liner, the location of the actuator assembly, and some components of the base assembly.

As depicted in FIGS. 2B and 1B, the actuator rod members 79*a* and 79*b* angle toward the back of the trash can where the rod members 79*a* and 79*b* enter the main hinge bracket 63. This backward angle allows the main portion of the rod members 79*a* and 79*b* to be maintained close to the back of the trash can from the base assembly 10 to the main hinge bracket 63, contributing to an aesthetically pleasing appearance, a reduced space required to place the trash can, and allowing placement of the trash can closer to a wall or corner than would be possible if the rod members 79*a* and 79*b* did not exhibit this backward angling.

When the trash can 100 is fully assembled, the main hinge bracket 63 is mounted to the shell 30 through the use of mounting holes 33 and suitable mounting hardware. As reflected in the figures, when the trash can 100 is assembled as described above, the rod members 79*a* and 79*b* will extend upwardly from openings 23*a* and 23*b*, within the interior of the shell 30 and then outward from, the shell 30, through slots 32*a* and 32*b* to a point where they are coupled, on the outside of the shell, to the upper lid hinge 62.

Figure 5A:
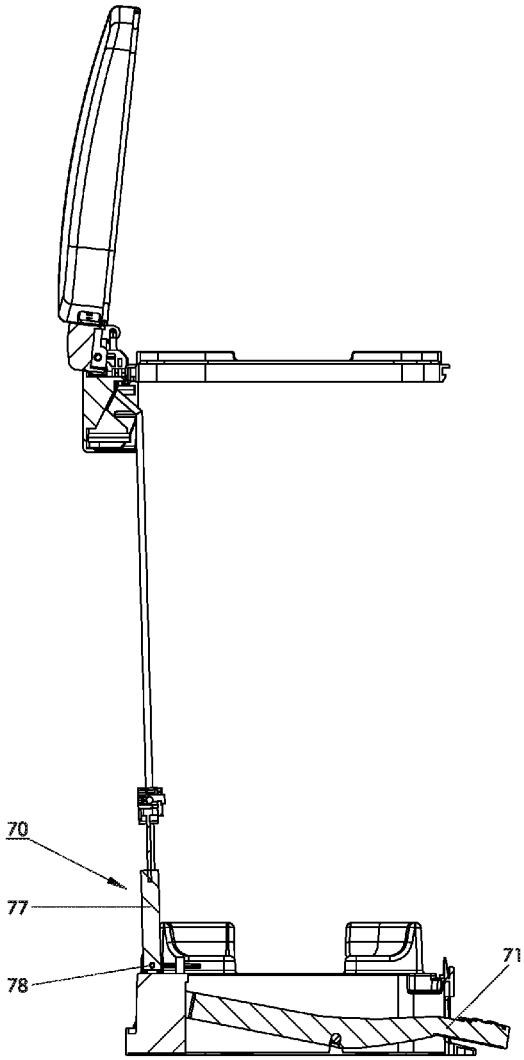
FIG. 5A illustrates a cross-sectional side view of a trash can in accordance with one embodiment of the present invention illustrating the lid in an open position and an example of an accompanying position of the pedal assembly.
Figure 5B:
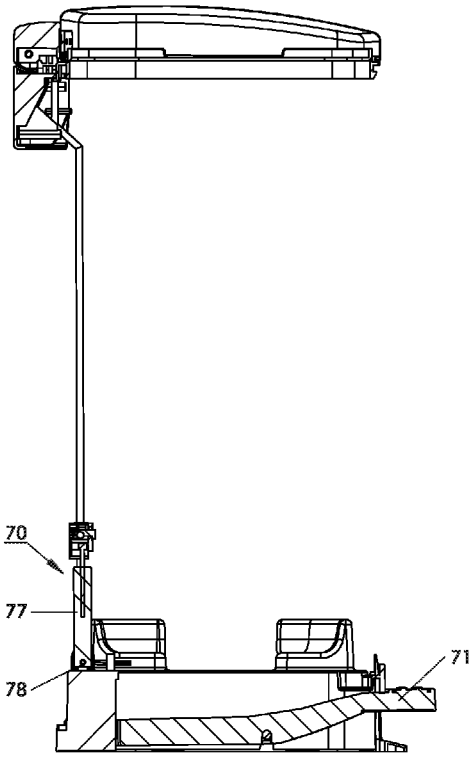
FIG. 5B illustrates a cross-sectional side view of a trash can in accordance with one embodiment of the present invention illustrating the lid in a closed position and an example of an accompanying position of the pedal assembly.

As previously described, when the lid and hinge assembly 60 is positioned as described above, depression of the pedal 71 will result in an upward movement of the rod members 79*a* and 79*b* and an opening of the main lid 61. The general operation of this structure is shown in FIGS. 5A and 5B which depict the trash can 100 with the pad assembly in both its open (FIG. 5A) and closed (FIG. 5B) positions.

As reflected in FIGS. 1B and 2A, in the illustrated embodiment, pedal 71 is shaped and sized in such a manner to maximize the packing efficiency of the trash can for shipment. In light of the external dimensions of shell 30 and base assembly 10, the length of pedal 71 may be set to allow an even number of trash cans to be packed for shipment on a shipping pallet while minimizing unused or empty space on the shipping pallet. For example, a standard size for shipping pallets is 40-inches by 48 inches. The length of pedal 71 may be sized so that, in light of the dimensions of shell 30 and base assembly 10, the trash can may be stacked three units deep on the shipping pallet without leaving empty space on the pallet.

As reflected in FIG. 1B, in the illustrated embodiment, a pedal plate 73 is affixed to the portion of the pedal 71 that extends outwardly from the opening 11. The pedal plate 73 covers substantially the entire surface of pedal 71 and may be made of a material different from that used to form the pedal 71. For example, pedal plate 73 may be of plastic, rubber, stainless steel, or any other suitable material.

The pedal plate 73 may be such that it is permanently fixed into position during manufacture or it may be interchangeable. When an interchangeable pedal plate is used, the material used to form the pedal plate 73 may be selected in accordance with various criteria including, in some embodiments, aesthetic criteria. In other embodiments, the pedal plate 73 may be selected to provide some specific designation relating to the intended use of the trash can 100. For example, in one such embodiment, the pedal plate 73 may include markings or designations to identify the intended location at which the trash can should normally be used (e.g., OFFICE, WASHROOM, etc.). This can help in the proper replacement of the trash can after cleaning operations. In other embodiments, the pedal plate 73 may include designations for the types of materials to be placed in the trash can 100 (such as a designation that products of only a single type—e.g., cans—should be placed in the trash can 100). Still further, the pedal plate may include a designation identifying the owner of the trash can 100 (e.g., X CORP).

As the above indicates, through the use of optional replaceable pedal plates 73 and the quick-mounts described above, the trash can 100 can be modified and customized to meet a number of different desired operating characteristics.

Referring back to FIGS. 1A and 1B, the exemplary trash can 100 includes a liner 50. In the illustrated example, the liner 50 is formed from plastic. As reflected in FIG. 1B, in the illustrated example, the liner 50 includes a curled outer lip 51 that defines two handle elements 52*a* and 52*b*. The exemplary liner 50 also defines indented channels both on its front side 53 to provide structural strength and a rear side (not illustrated) that is sized to ensure adequate clearance between the shell 30 and the rod members 79*a* and 79*b*.

In the illustrated example, the liner 50 also includes a venting hole 54 which creates an air path to assist in the placement and removal of trash bags within and about the liner 50. In embodiments where liquid materials are to be placed within the trash can 100, the venting hole 54 may be eliminated or a plug may be positioned in the hole to prevent fluid leakage.

As reflected in FIGS. 1A and 1B, the trash can 100 further includes a trim ring 40. The trim ring is sized and shaped to fit about the upper surface of shell 30. The trim ring may be formed of any suitable materials such as plastic or rubber. In embodiments where a relatively tight seal is desired, the trim ring may be, or may include, a flexible gasket-like material to form a seal with the main lid 61. Like the pedal plate 73, the trim ring 40 may be customized for various applications or aesthetic appearances. For example, in applications where metal objects may be placed in the trash can 100 and damage to the shell 30 is desired to be avoided, the trim ring 40 may be of a hardened material and may have a portion that extends downwardly about the top outer surface of the shell 30 to provide protective surface. In other embodiments, such as where quiet operation of the trash can 100 is desired, the trim ring 40 may be formed of, or include, soft compliant materials such that there is minimal or no noise created when the lid and hinge assembly 60 is closed. Still other embodiments are envisioned where the trash can 100 is intended to receive only materials of a certain size or shape. In such examples, the trim ring 40 may be formed to include a screen cover (or other shaped cover) to only allow passage of items of the desired shapes and/or sizes. Finally, in some embodiments, the trip ring 40 may be selected for specific aesthetic reasons.

While the illustrated example describes above, alternate embodiments are envisioned where the trim ring 40 is eliminated and the lid assembly makes direct contact with the shell 30 or the liner 50. Still other embodiments are envisioned where a trim ring is coupled to the main lid 61 instead or, or in addition to, the trim ring on the shell 30.

Figure 6:
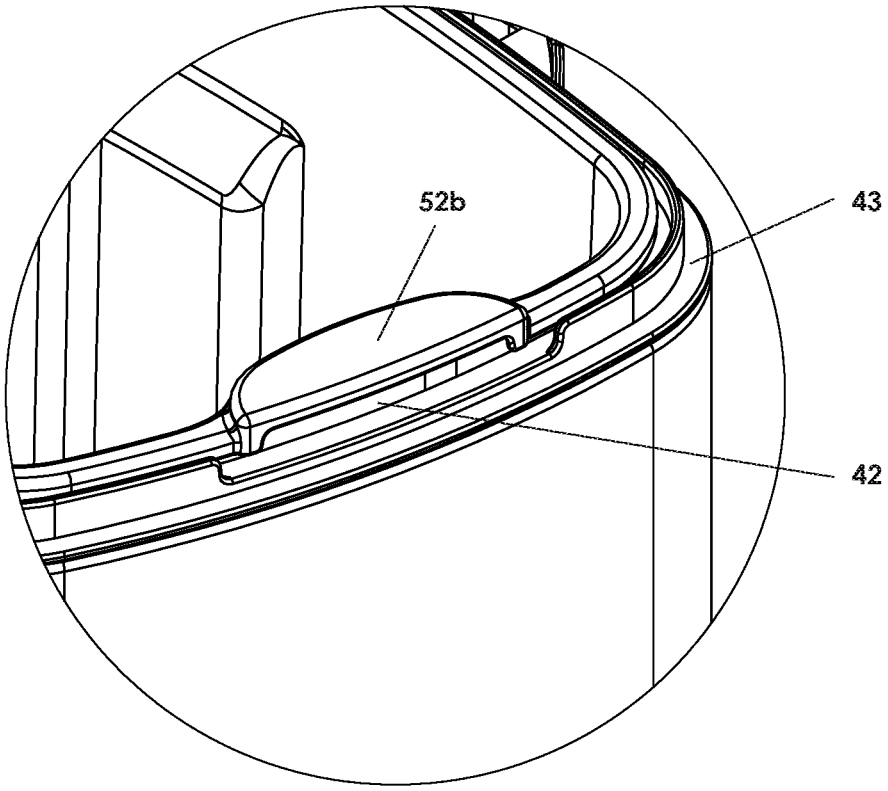
FIG. 6 illustrates a detail of a perspective view of a trash can in accordance with one embodiment of the present invention illustrating the handle and notch elements in relation to the trim ring and ledge-like structure of the trim ring.

In the example described above, the trim ring 40 defines notched sections 42 that, in connection with the raised sections of the liner 50, enable efficient removal of the liner 50. These exemplary aspects of the trash can 100 are shown in more detail in FIG. 6 where it is seen that the interface between notched section 42 and raised handle element 52*b* provides a clearance area enabling easy grasping and removal of the liner 50. Ease of grasping and removal of the liner 50 may be further enhanced where the weight of the liner 50 is supported by the pedestal elements 19 of base assembly 10 such that the weight of the liner 50 is not resting on the trim ring 40. A further benefit beyond ease of grasping the liner 50 is that the weight of the trash contained in the liner is not resting on the trim ring 40 and the shell 30. However, in alternate embodiments, the weight of the liner 50 may be supported by the trim ring 40 rather than by the base assembly 10.

The exemplary trim ring 40 includes an outwardly extending ledge-like structure 43 that aligns with the top of the shell 30 and a downwardly extending ring 44 that, in the illustrated example, includes tabs 45 that can engage a portion of the shell 30. In the illustrated example, the upper portion of the shell 30 is inwardly rolled and the tabs 45 engage the inward roll.

Figure 7A:
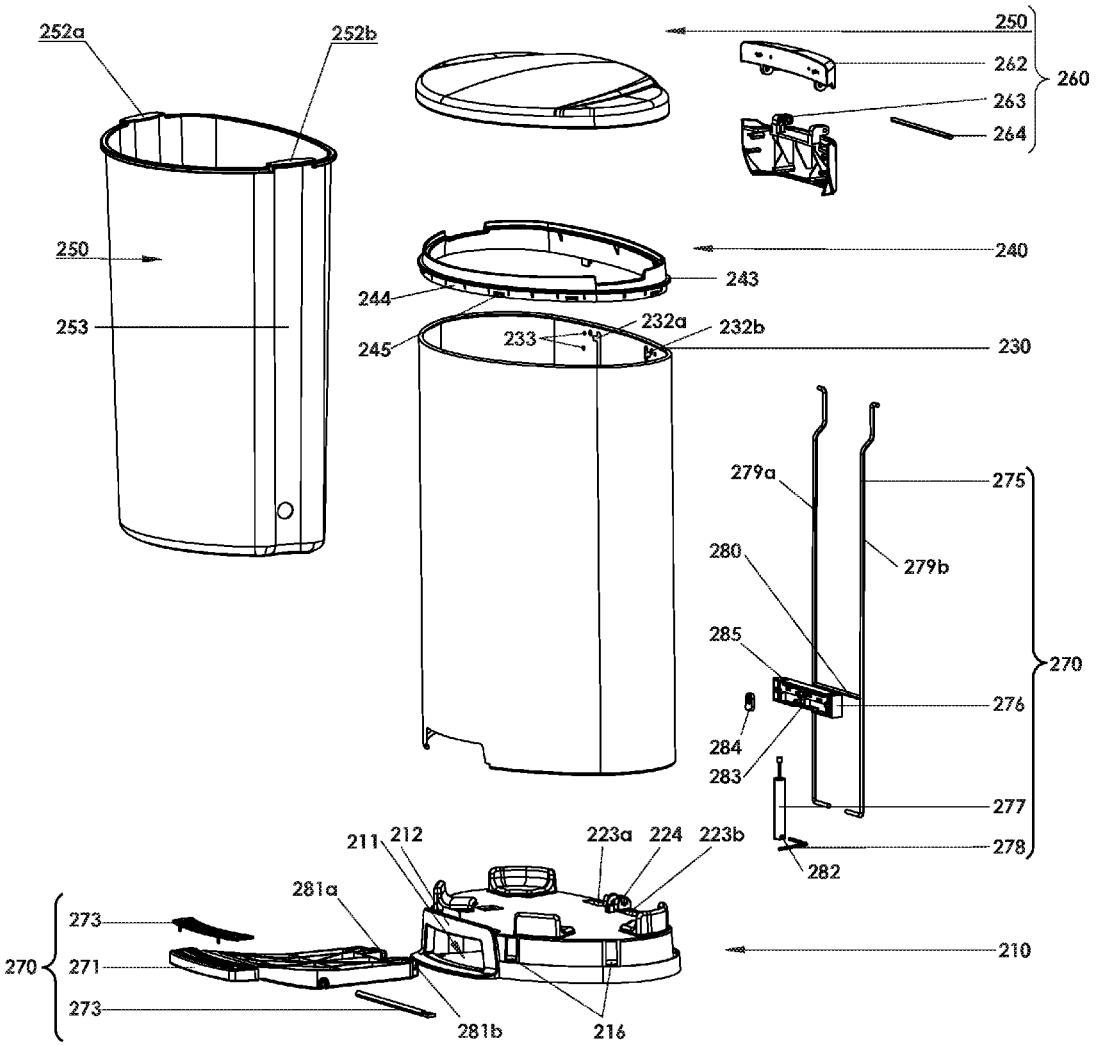
FIG. 7A illustrates an exploded front perspective view of a trash can according to an alternate embodiment of the present invention, further illustrating the components of the base assembly and components, the actuator assembly and components, and the lid assembly and components, as well as the liner and trim ring.
Figure 7B:
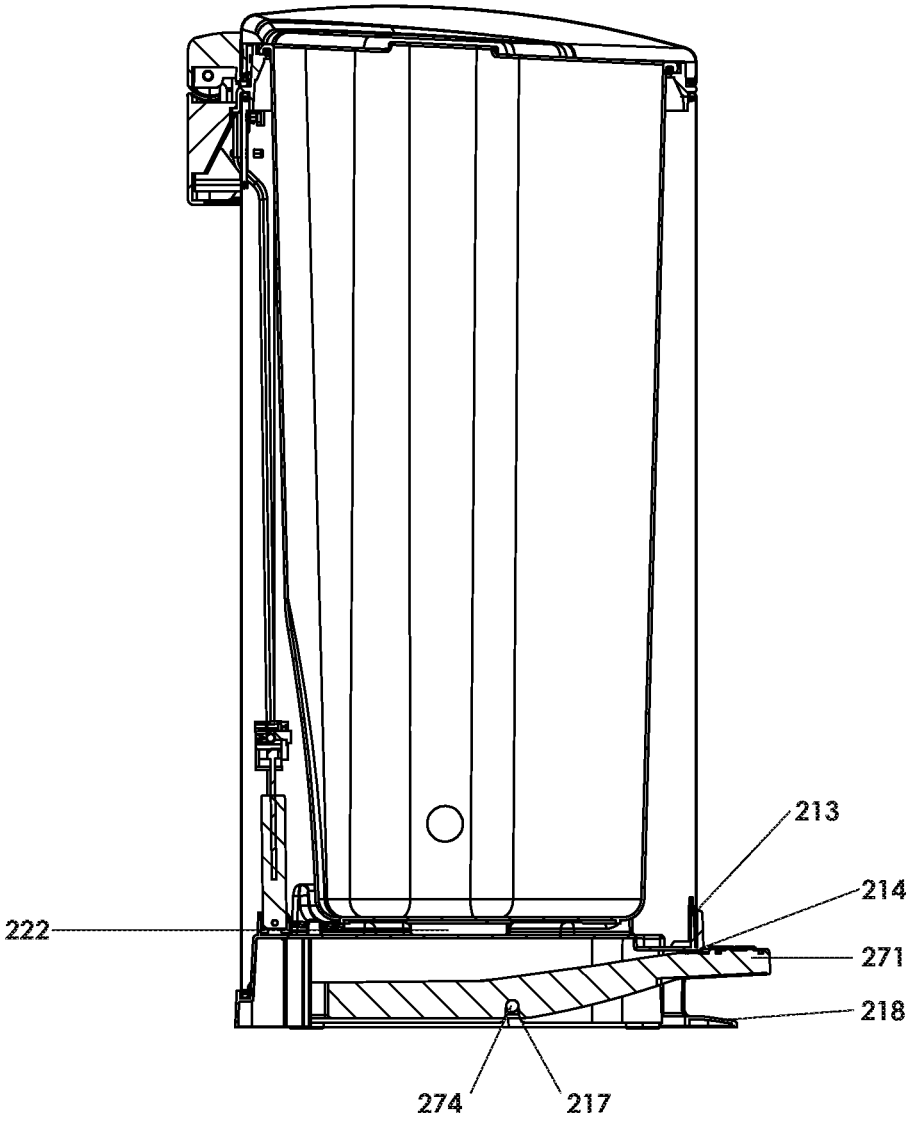
FIG. 7B illustrates a cross-sectional side view of a trash can according to an alternate embodiment of the present invention showing the location of the actuator assembly and some components of the base assembly.

The trash can 100 described above is but one example of a trash can incorporating the beneficial features described herein. Other variations are possible. For example, FIGS. 7A and 7B illustrate an alternate trash can 200. Unlike trash can 100—that is generally rectangular in shape—trash can 200 is more oval and "D-shaped" in its cross section.

As depicted, trash can 200 includes the mechanical features as described herein with regard to trash can 100, and numbering of objects depicted in FIGS. 7A and 7B are consistent with those numbered objects described herein with respect to trash can 100 with the addition of the numeral 2 in the hundreds place, such as liner 50 and liner 250, and opening 23 and opening 223. The description for such similar numbered elements that are shown in FIGS. 7A and 7B have been described above and are not believed to require further description relative to FIGS. 7A and 7B.

For instance, trash can 200 includes a shell 230 having openings 232*a* and 232*b* and mounting holes 233 similar to those described above with respect to shell 230. Like the trash can 100, the trash can 200 also includes a actuator assembly 270 that includes rod members 279*a* and 279*b* arranged in a parallel-vertical arrangement coupled together by a cross-bar member 280. The trash can 200 of FIGS. 7A and 7B includes a hydraulic cartridge 277, the cartridge is coupled to the base assembly 210 through the quick-release direct pivot mount as previously described. Similar to the design of trash can 100, trash can 200 includes a liner 250, a trim ring 240, and a lid and hinge assembly 260 that generally operate as previously described.

The above embodiments are illustrative and not limiting. Other and further embodiments utilizing one or more aspects of the inventions described above can be devised without departing from the spirit of Applicants' invention.

Further, when steps are described—unless specifically indicated otherwise—the order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements.

What is claimed is:

1. A system for improving the operation of a trash can, the system comprising:

a lid adapted to optionally cover at least a portion of an opening through which a shell is adapted to receive trash;

an actuator assembly configured to dispose the lid in two or more positions relative to the opening and to move the lid there between, the actuator assembly including a pedal configured to move relative to the shell;

an actuator rod assembly having a first end rotatably coupled to the pedal and a second end rotatably coupled to the lid, the actuator rod assembly including two at least partially parallel rod members coupled together with a brace disposed between the first and second ends of the actuator rod assembly; and a cross-bar member coupled to and extending between the rod members;

a base configured to support at least a portion of the actuator assembly; and a hydraulic component having a first end rotatably coupled to the base and a second end coupled to the actuator assembly, wherein the hydraulic component is adapted to rotate relative to the base as the lid is moved from one position to another position relative to the opening.

2. A system for improving the operation of a trash can according to claim 1, further comprising a mount adapted to couple the hydraulic component to the base.

3. A system for improving the operation of a trash can according to claim 2, wherein the hydraulic component is rotatably coupled to the mount with a pin.

4. A system for improving the operation of a trash can according to claim 1, wherein the rod members and cross-bar member are each coupled to the brace.

5. A system for improving the operation of a trash can according to claim 4, wherein the brace prevents the rod members from moving independently with respect to each other.

6. A system for improving the operation of a trash can according to claim 1, further comprising a pedal stop, wherein the pedal stop is adapted to prohibit the pedal from contacting a surface beneath the base when the pedal is in a lowermost position.

7. A trash can; comprising:

a lid adapted to optionally cover at least a portion of an opening through which a shell is adapted to receive trash;

an actuator assembly configured to dispose the lid in two or more positions relative to the opening and to move the lid there between, the actuator assembly including a pedal configured to move relative to the shell;

an actuator rod assembly having a first end rotatably coupled to the pedal and a second end rotatably coupled to the lid, the actuator rod assembly including two at least partially parallel rod members coupled together with a brace disposed between the first and second ends of the actuator rod assembly; and a cross-bar member coupled to and extending between the rod members;

a base configured to support at least a portion of the actuator assembly; and a hydraulic component having a first end rotatably coupled to the base and a second end coupled to the actuator assembly, wherein the hydraulic component is adapted to rotate relative to the base as the lid is moved from one position to another position relative to the opening.

8. The trash can of claim 7, wherein the rod members and cross-bar member are each coupled to the brace.

9. The trash can of claim 8, wherein the brace prevents the rod members from moving independently with respect to each other.

10. The trash can of claim 7, further comprising a pedal stop, wherein the pedal stop is adapted to prohibit the pedal from contacting a surface beneath the base when the pedal is in a lowermost position.

11. A trash can, comprising:

a shell adapted to receive at least one of a liner and trash through an opening in the shell;

a lid configured to optionally cover and uncover at east a portion of the opening, the lid being rotatably coupled to the shell;

a base coupled to the shell and configured to support the shell in an upright position; and an actuator assembly configured to rotate the lid relative to the shell, the actuator assembly comprising a pedal configured to move relative to the base;

an actuator rod assembly having a first end rotatably coupled to the pedal and a second end rotatably coupled to the lid, the actuator rod assembly including two at least partially parallel rod members coupled together with a brace disposed between the first and second ends of the actuator rod assembly;

a hydraulic component having a first end coupled to the base and a second end coupled to the actuator rod assembly; and a cross-bar member coupled to and extending between the rod members;

wherein the hydraulic component is adapted to rotate relative to the base as the lid is moved from one position to another position relative to the opening.

12. The trash can of claim 11, wherein the actuator assembly is configured to open and close the lid at different rates.

13. The trash can of claim 11, wherein the cross-bar member is at least partially surrounded by the brace.

14. The trash can of claim 11, further comprising a pivot mount and a pin, wherein the first end of the hydraulic component is rotatably coupled to the pivot mount with the pin.

* * * * *